US005832441A

United States Patent [19]

Aaron et al.

[11] Patent Number: 5,832,441

[45] Date of Patent: Nov. 3, 1998

[54] CREATING SPEECH MODELS

[75] Inventors: Joseph David Aaron, Austin; Peter Thomas Brunet, Round Rock; Catherine Keefauver Laws; Robert Bruce Mahaffey, both of Austin, all of Tex.; Carlos Victor Pinera, Boca Raton, Fla.

[73] Assignee: International Business Machines Corporation, Armonk, N.Y.

[21] Appl. No.: 710,148

[22] Filed: Sep. 16, 1996

[51] Int. Cl.[6] ..... G10L 9/00

[52] U.S. Cl. ..... 704/276; 704/271

[58] Field of Search ..... 704/270, 278, 704/260, 251, 254, 243, 200, 231, 267, 244, 245, 275, 255, 258, 271, 276, 272

[56] References Cited

U.S. PATENT DOCUMENTS

| | | | |
|---|---|---|---|
| 4,335,276 | 6/1982 | Bull et al. | 704/276 |
| 4,779,209 | 10/1988 | Stapleford et al. | 364/513.5 |
| 4,977,599 | 12/1990 | Bahl et al. . | |
| 4,996,707 | 2/1991 | O'Malley et al. . | |
| 5,027,406 | 6/1991 | Roberts et al. . | |
| 5,111,409 | 5/1992 | Gasper et al. . | |
| 5,151,998 | 9/1992 | Capps | 395/800 |
| 5,208,745 | 5/1993 | Quentin et al. . | |
| 5,219,291 | 6/1993 | Fong et al. | 434/323 |
| 5,230,037 | 7/1993 | Giustiniani et al. . | |
| 5,313,531 | 5/1994 | Jackson . | |
| 5,313,556 | 5/1994 | Parra | 704/246 |
| 5,327,498 | 7/1994 | Hamon . | |
| 5,429,513 | 7/1995 | Diaz-Plaza . | |
| 5,448,679 | 9/1995 | McKiel, Jr. . | |
| 5,475,792 | 12/1995 | Stanford et al. . | |
| 5,487,671 | 1/1996 | Shpiro et al. | 434/185 |
| 5,500,919 | 3/1996 | Luther . | |
| 5,524,172 | 6/1996 | Hamon . | |
| 5,704,007 | 12/1997 | Cecys | 704/270 |
| 5,717,828 | 2/1998 | Rothenberg | 704/275 |

OTHER PUBLICATIONS

IBM Technical Disclosure Bulletin, vol. 28, No. 08 Jan. 1986, Autocorrelation–Faces: An AID To Deaf Children Learning To Speak.

IBM Technical Disclosure Bulletin, vol. 36 No. 06B Jun. 1993, Method for Text Annotation Play Utilizing a Multiplicity of Vocies.

IBM Technical Disclosure Bulletin, vol. 38 No. 05 May 1995, Producing Digitized Voice Segments.

*Primary Examiner*—Richemond Dorvil
*Attorney, Agent, or Firm*—Jeffrey S. LaBaw

[57] ABSTRACT

Selecting human speech samples for a speech model of human speech is preformed. The system presents a graphic representing a human speech sample on a computer display, e.g., an amplitude vs. time graph of the speech sample. Through user input, the system marks a segment of the graphic. The marked segment of the graphic represents a portion of the human speech sample. The system plays the portion of the human speech sample represented by the marked segment back to the user to allow the user to determine its acceptability for inclusion in the speech model. If so indicated by the user, the portion of the human speech sample represented by the marked segment is selected for inclusion in the speech model. The system also analyzes the portion of the human speech sample represented by the marked segment for acoustic properties. These properties are presented to the user in a graphic of the analyzed portion representative of the acoustic properties, e.g., a spectral analysis of the sample graphed as a set of spectral lines. Thus, the user can select the analyzed portion for inclusion in the speech model due to the presence of desired acoustic properties in the analyzed portion.

21 Claims, 10 Drawing Sheets

CREATING SPEECH MODELS

BACKGROUND OF THE INVENTION

This invention relates generally to acoustic analysis of sound. More particularly, it relates to analysis of human speech and the generation of acceptable models for evaluation of incoming human speech.

There are several professions in which speech professionals make assessments of the accuracy and progress in producing particular types of human speech. Speech pathologists are professionals who work with individuals who do not speak in a "normal" manner. This may be due to various speech impediments or physical deficiencies which impair these individuals' abilities to produce what would be considered normal human speech. Typically, a speech pathologist will work with such an individual over a period of time to teach him how to more accurately produce the desired sounds. Similarly, language coaches teach a student a foreign language, with the proper accent and so forth. Actors frequently use dialect coaches; professional singers take voice lessons. Although the type of speech and sounds vary within the particular disciplines of these specialties, they share common thread in that human speech is made and, through a series of lessons, hopely improved.

Like many tasks in today's society, computers and computer software have provided important tools to improve these processes. For example, SpeechViewer, a product of the IBM Corporation, provides analytic feedback about speech for speech and language pathologists. One of SpeechViewer's features is that it analyzes an incoming speech sample with comparisons to spectra of a stored speech sample to determine whether a particular sound, e.g., phoneme, has been made correctly. Further, it is also important that the phoneme model does not contain extraneous spectra. Once the phoneme model is created, an incoming sound can be compared to the model. If the incoming sound does not fit within the range, it is so indicated to the user.

One of the deficiencies of the SpeechViewer product was the difficulty in creating an appropriate phoneme model. Sustained phoneme such as a sustained /oo/ phoneme contain many acoustic variations which the human ear perceives as the intended phoneme. When a phoneme model is created, it is critical that the model contain the varieties of the correct phoneme's spectral distribution which an ear would perceive as the intended phoneme. A further problem which must be addressed is that not all individuals are capable of normal speech. An individual with a cleft palate or other deformity may never produce a phoneme with the same accuracy that an average person might. Thus, a phoneme model for a particular client cannot simply use a phoneme model generated by an actor or speech professional stored in the system. The phoneme model must be created as a best rendition of a particular phoneme that the individual may be expected to create.

The prior art method used by SpeechViewer did not provide an automatic means of discriminating between candidate phoneme samples in the process of creating phoneme models. Spectra were gathered as a phoneme was uttered and no feedback was provided to the user as to the quality of the spectra other than that the utterance was too long, too soft, or not loud enough. All incoming spectra regardless of their spectral acceptability were recorded.

This invention represents an important improvement to the state of the art.

SUMMARY OF THE INVENTION

It is therefore an object of the invention to selectively include candidate samples of human speech in a model of the human speech.

It is another object of the invention to play back a candidate sample of human speech so that the user can determine its acceptability for inclusion in the speech model.

It is another object of the invention to display an analysis of the candidate sample to determine its acceptability for inclusion in the speech model.

It is another object of the invention to allow the user to extract a portion of a captured speech sample as a candidate speech sample.

It is another object of the invention to play back and analyze the extracted portion of the captured speech sample to determine its acceptability for the speech model.

It is another object of the invention to compact the speech model to minimize the storage required.

These objects and other features and advantages are accomplished by a technique for selecting human speech samples for a speech model of human speech. The system presents a graphic representing a human speech sample on a computer display, e.g., an amplitude vs. time graph of the speech sample. Through user input, the system marks a segment of the graphic. The marked segment of the graphic represents a portion of the human speech sample. The system plays the portion of the human speech sample represented by the marked segment back to the user to allow the user to determine its acceptability for inclusion in the speech model. If so indicated by the user, the portion of the human speech sample represented by the marked segment is selected for inclusion in the speech model.

The system also analyzes the portion of the human speech sample represented by the marked segment for acoustic properties. These properties are presented to the user in a graphic of the analyzed portion representative of the acoustic properties, e.g., a spectral analysis of the sample graphed as a set of spectral lines. Thus, the user can select the analyzed portion for inclusion in the speech model due to the presence of desired acoustic properties in the analyzed portion.

BRIEF DESCRIPTION OF THE DRAWINGS

These objects, features and advantages will be more readily understood with reference to the attached figures and following description.

DETAILED DESCRIPTION OF THE PREFERRED EMBODIMENT

The present invention provides analytical feedback about speech to users. It may be used by Speech\Language Pathologists, Teachers of the Deaf, and other professionals who work with voice, dialects, foreign languages, and/or singing. It translates the output of acoustic analyses, such as fundamental frequency, signal intensity, and spectral information into animated graphical feedback which varies as functions of the sound.

In one of the preferred embodiments of the invention, a speech pathologist will access the acceptability of isolated speech sounds (phonemes) in the recorded speech of a client.

The system makes an objective analysis of phoneme acceptability by statistically comparing the spectra of incoming speech with spectra of stored phoneme models that have been created and stored by the speech professional. It is that professional's subjective judgment of phoneme acceptability that serves as the validation of the model and resulting feedback about phoneme accuracy. The disclosure below describes one preferred embodiment of the user interface and the acoustic procedure that is used for creating the phoneme models.

The invention may be run on a variety of computers or collection of computers under a number of different operating systems. The computer could be, for example, a personal computer, a mini computer, mainframe computer or a computer running in a distributed network of other computers. Although the specific choice of computer is limited only by processor speed and disk storage requirements, computers in the IBM PC series of computers could be used in the present invention. For additional information on IBM's PC series of computers, the reader is referred to *IBM PC* 300/700 *Series Hardware Maintenance* Publication No. S83G-7789-03 and *User's Handbook IBM PC Series* 300 *and* 700 Publication No. S83G-9822-00. One operating system which an IBM personal computer may run is IBM's OS/2 Warp 3.0. For more information on the IBM OS/2 Warp 3.0 Operating System, the reader is referred to *OS/2 Warp V3 Technical Library* Publication No. GBOF-7116-00.

Figure 1:
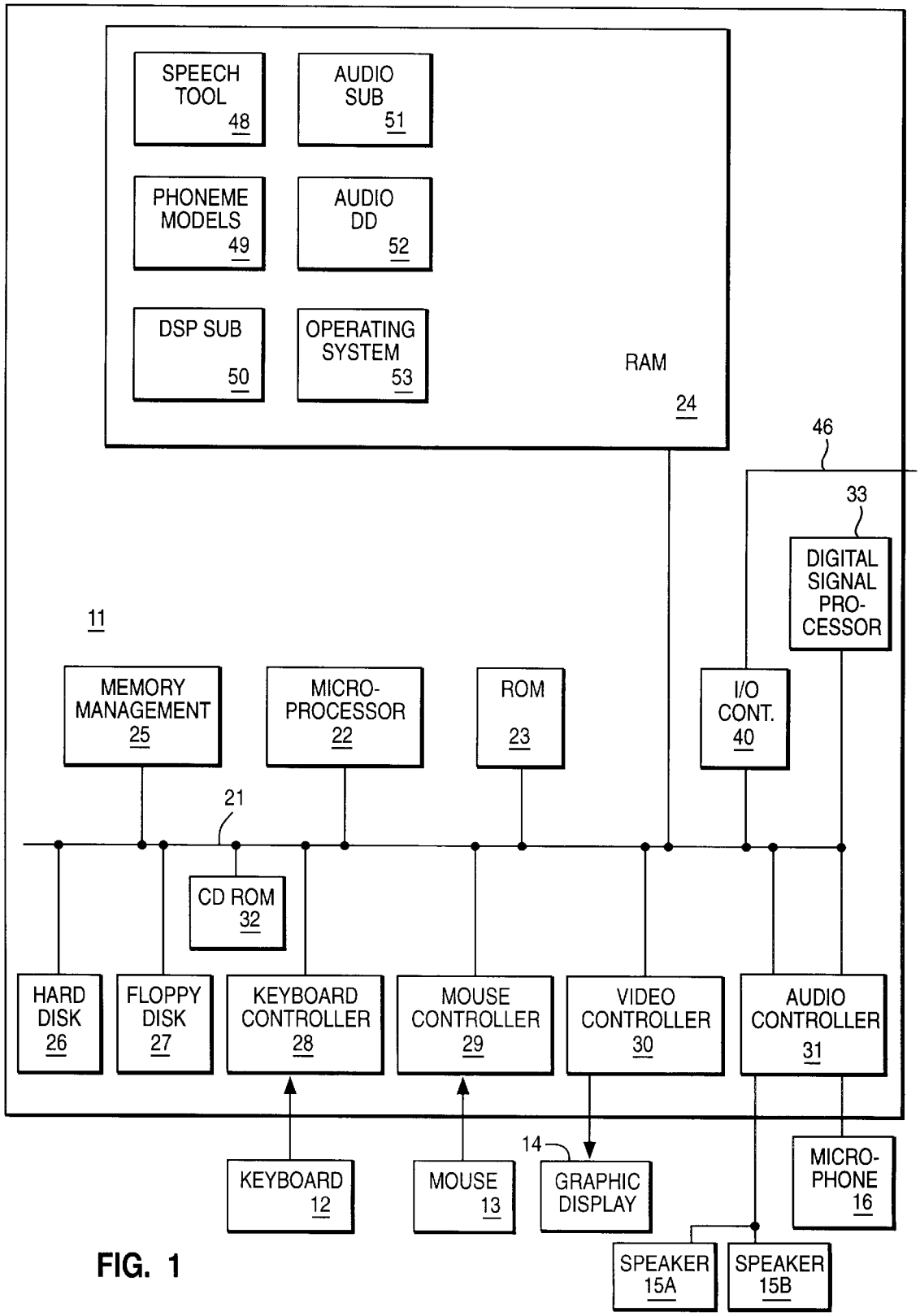
FIG. 1 depicts a computer system configured according to the teachings of the present invention.

In FIG. 1, a computer 10, comprising a system unit 11, a keyboard 12, a mouse 13 and a display 14 are depicted in block diagram form. The system unit 11 includes a system bus or plurality of system buses 21 to which various components are coupled and by which communication between the various components is accomplished. The microprocessor 22 is connected to the system bus 21 and is supported by read only memory (ROM) 23 and random access memory (RAM) 24 also connected to system bus 21. A microprocessor in the IBM PS/2 series of computers is one of the Intel family of microprocessors including the 386, 486 or Pentium microprocessors. However, other microprocessors including, but not limited to, Motorola's family of microprocessors such as the 68000, 68020 or the 68030 microprocessors and various Reduced Instruction Set Computer (RISC) microprocessors such as the PowerPC chip manufactured by IBM or other microprocessors made by Hewlett Packard, Sun, Motorola and others may be used in the specific computer.

The ROM 23 contains among other code the Basic Input-Output system (BIOS) which controls basic hardware operations such as the interaction of the disk drives and the keyboard. The RAM 24 is the main memory into which the operating system and application programs are loaded. The memory management chip 25 is connected to the system bus 21 and controls direct memory access operations including, passing data between the RAM 24 and hard disk drive 26 and floppy disk drive 27. The CD ROM 32 also coupled to the system bus 21 is used to store a large amount of data, e.g., a multimedia program or presentation.

Also connected to this system bus 21 are various I/O controllers: The keyboard controller 28, the mouse controller 29, the video controller 30, and the audio controller 31. As might be expected, the keyboard controller 28 provides the hardware interface for the keyboard 12, the mouse controller 29 provides the hardware interface for mouse 13, the video controller 30 is the hardware interface for the display 14, and the audio controller 31 is the hardware interface for the speakers 15 and the microphone 16. The audio controller card may be a multimedia sound card, e.g., a Sound Blaster™ or Mwave™ DSP based sound card. An I/O controller 40 such as a Token Ring Adapter enables communication over a network 46 to other similarly configured data processing systems.

One of the preferred implementations of the invention is as sets of instructions 48–53 resident in the random access memory 24 of one or more computer systems configured generally as described above. Until required by the computer system, the set of instructions may be stored in another computer memory, for example, in the hard disk drive 26, or in a removable memory such as an optical disk for eventual use in the CD-ROM 32 or in a floppy disk for eventual use in the floppy disk drive 27. One skilled in the art would appreciate that the physical storage of the sets of instructions physically changes the medium upon which it is stored electrically, magnetically, or chemically so that the medium carries computer readable information.

While it is convenient to describe the invention in terms of instructions, symbols, characters, or the like, the reader should remember that all of these and similar terms should be associated with the appropriate physical elements. Further, the invention is often described in terms of comparing or analyzing or other terms that could be associated with human operator. No action by a human operator is desirable in any of the operations described herein which form part of the present invention; the operations are machine operations processing electrical signals to generate other electrical signals.

Figure 2:
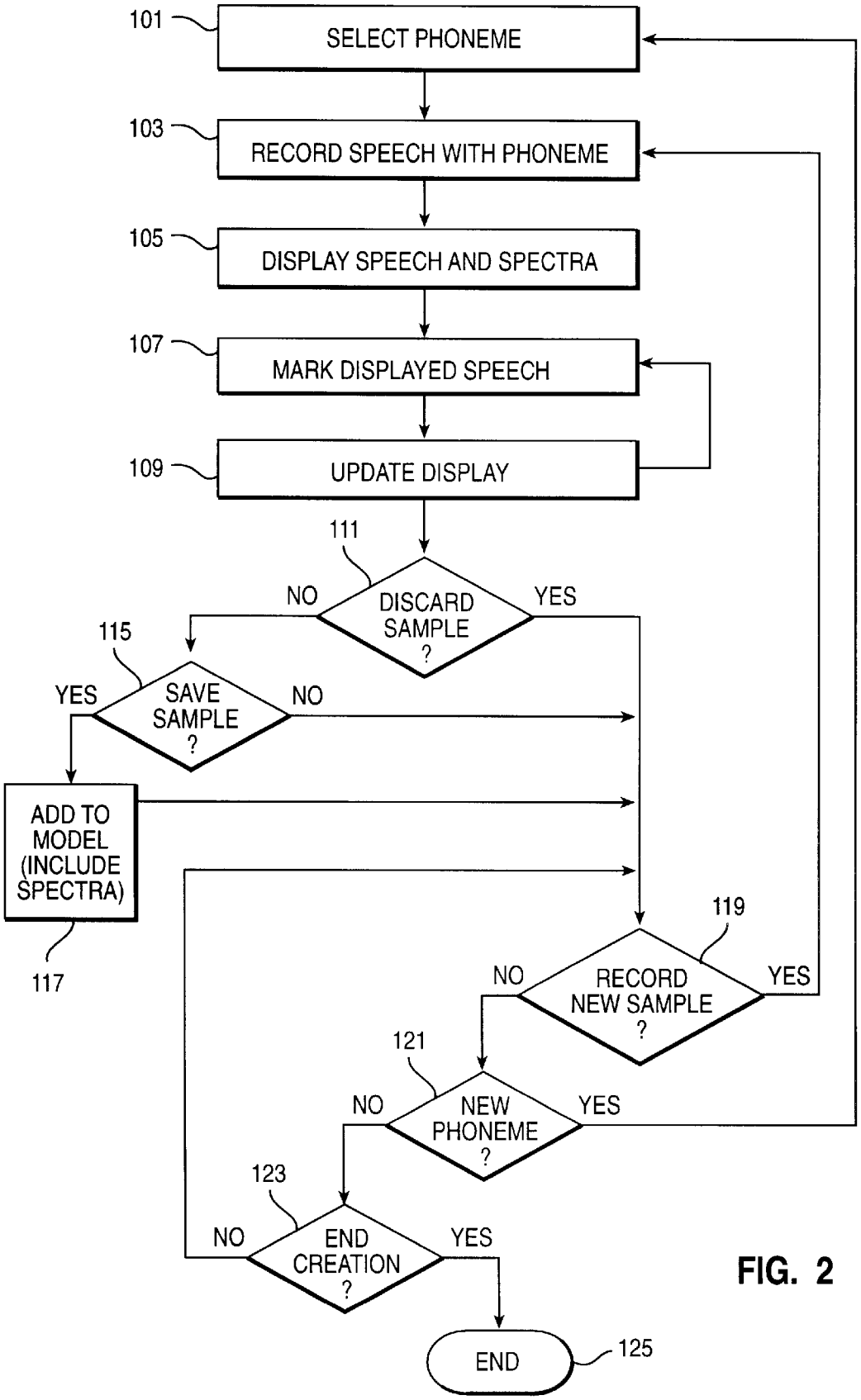
FIG. 2 is a flow diagram of the overall process for creating a phoneme model according to the present invention.

The overall process flow of one preferred embodiment of the invention is shown in FIG. 2. The system utilizes user input to create an acceptable phoneme model as described below. In step 101, user input for the selected phoneme for which the model is to be created is accepted by the system through the use of a user interface. The user interface may be a window with a scrollable list of selectable phonemes or a popup panel with a series of check boxes next to the selectable phonemes or any number of suitable user interfaces known to the art.

In step 103, the system waits to record or import a speech sample which contains the selected phoneme. In the case of a real time speech session, the user interface may display a message to the user indicating the system's state of readiness to accept speech input. The system accepts the speech sample for further processing.

In step 105, the system displays the processed speech to the user via a user interface. Analog to digital conversion would occur for real time speech, preferably in the DSP of the audio card. The system must analyze the sound components and process them for display. One preferred user interface is described below and shown in FIGS. 3–5. The analysis process is described in greater detail below.

In step 107, the system accepts user input to isolate a portion of the speech sample as the selected phoneme. In one preferred embodiment, the system will make an attempt to make a "best guess" as to which section of the displayed speech is the selected phoneme. That is, the system may make a comparison of portions of the incoming speech sample with the stored samples. The user would then be able to modify the system's attempt to find the selected spectra by interacting with the interface. In the preferred embodiment of the interface shown in FIGS. 3–5, vertical markers are used on a graphic representation of the speech sample, e.g., graphed on an x–y axis as amplitude by time, to display the isolated section of speech which represents the selected phoneme within the displayed speech sample.

The user may examine the spectra that have been calculated from the selected speech segment. The segment between the markers is graphed as spectra in a spectral display region. If the user moves the markers in an attempt to get a tighter set of spectra, in step 109, the system will display the spectra from the newly selected phoneme segment. Each spectral time represents the energy present at a particular small band of frequencies in the audio spectrum. A compact speech spectra will generally assure that the variations of the phoneme production are similar. Large variations in the spectra would indicate that other phonemes or speech aberrations are presented in the marked speech segment. A single phoneme has a particular spectral pattern which is due to the formation of the vocal tract. This pattern will vary slowly over time, but in a single 500 ms period. Great deviations in the displayed spectra may indicate that noise or other interruptions are included in the selected sample. Thus, a selected section of speech containing such deviations would not be a good candidate for inclusion in the phoneme model.

The system continues to adjust the positions of the vertical markers, and therefore, the extent of the candidate phoneme segment in response to user input in step 107 and update the display in step 109 until the user is satisfied or discards the speech sample from consideration. Thus the user is afforded the opportunity to adjust the selected sample, e.g., adjusting the vertical markers on the graph, until the deviations are no longer present.

Once a speech sample is collected, the user may listen to the selected phoneme segment by clicking with the right mouse button on the selected portion of the graphic display (not pictured). The system will play back the recorded sound through the speakers in response to such a request by the user. Thus, the invention allows the user to make a subjective judgment that the selected segment sounds like the selected phoneme. The user may iteratively examine the displayed spectra for a compact distribution and listen again to the selected speech segment and adjust the range of the selected speech segment until satisfied that the selected speech segment is representative of the selected phoneme. At this point, the process returns to step 101 for further user input.

If the user fails to find a suitable segment of the speech sample he may issue a command to discard the sample which the system will perform in step 111. The compaction threshold removes spectra that are too close as defined by the threshold and is used to save memory and increase the performance of recognition.

Once the user is satisfied with the selected speech segment, he may include the spectra in the collection of speech segments which represent the selected phoneme by input to the user interface, e.g., selection of an "Include the Spectra" pushbutton step 115. The phoneme models are saved in files containing records which consist of a 1 byte phoneme ID and 74 bytes of spectral content, that is, 74 amplitude values distributed across 74 frequency points from 0 to 10 kHz. The system, upon receiving this input, compacts the collection of new existing spectra in step 117 by eliminating ones that are similar to each other. This process is described in greater detail below.

The finally selected speech segment, displayed on the screen used to create the cluster of spectra, is saved as a file. The saved file can be played back by the user. This allows a user to understand how a sample of the selected phoneme is supposed to sound.

The process can return to step 103, in response to the user selection record new sample in step 119. The process can return to step 101 in response to a "Select Phoneme" input to create another phoneme model in step 121. At any time, the user may click on "Play Phoneme" (not shown). In response, the system plays back the sample of speech that has been saved to represent the selected phoneme. To provide the user with an auditory model of the target phoneme, the digitized sample of the target phoneme is saved. For a given phoneme model the longest sample is saved as the auditory model, i.e. if the current speech sample is shorter than the new speech sample it is replaced.

When all phoneme models have been created, saved and compacted, the user requests the system to end the creation of the phoneme model routine, step 123. The system goes to other processing, step 125. Various aspects of this general process will be discussed in greater detail below.

An example of other processing would be the use of the created phoneme model in one or more of the exercises provided by the speech tool. For example, the student can attempt to recreate the phoneme in a phoneme accuracy exercise. When the spectra contained in the produced speech comes within a prescribed distance of the spectra in the compacted phoneme model, "success" is signalled through the interface. Speech which is close, but not quite close enough can also be signalled to the student. For example, in one of the Speechviewer exercises a graphic of a girl sipping juice through a straw is presented. As the speech produced more closely approximate the phoneme model, the "juice" is shown higher and higher in the straw. When the phoneme is accurately produced by the student, the girl drinks the juice.

User Interface

Figure 3:
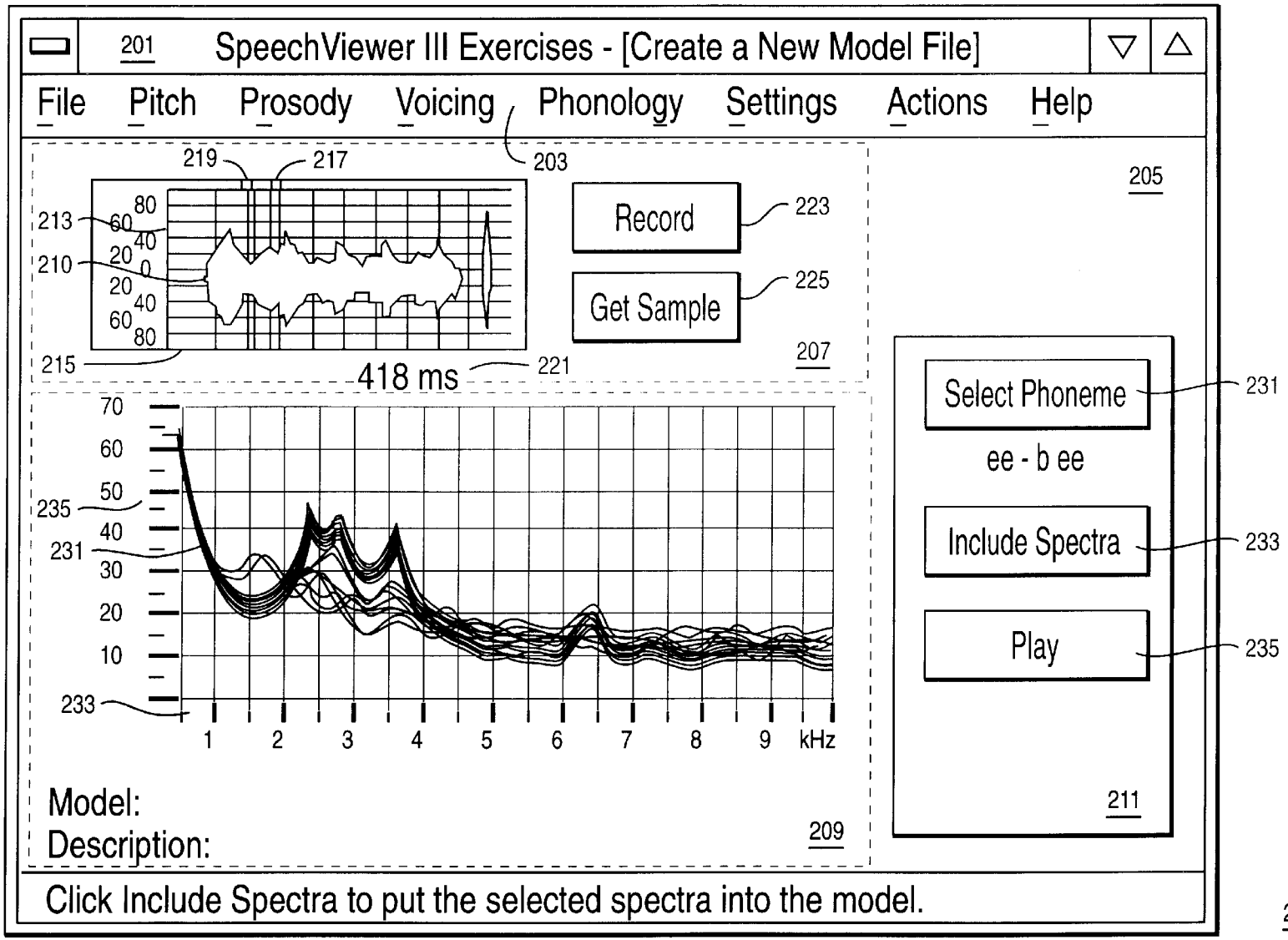
FIGS. 3–5 are successive displays of one preferred user interface for creating a phoneme model.
Figure 4:
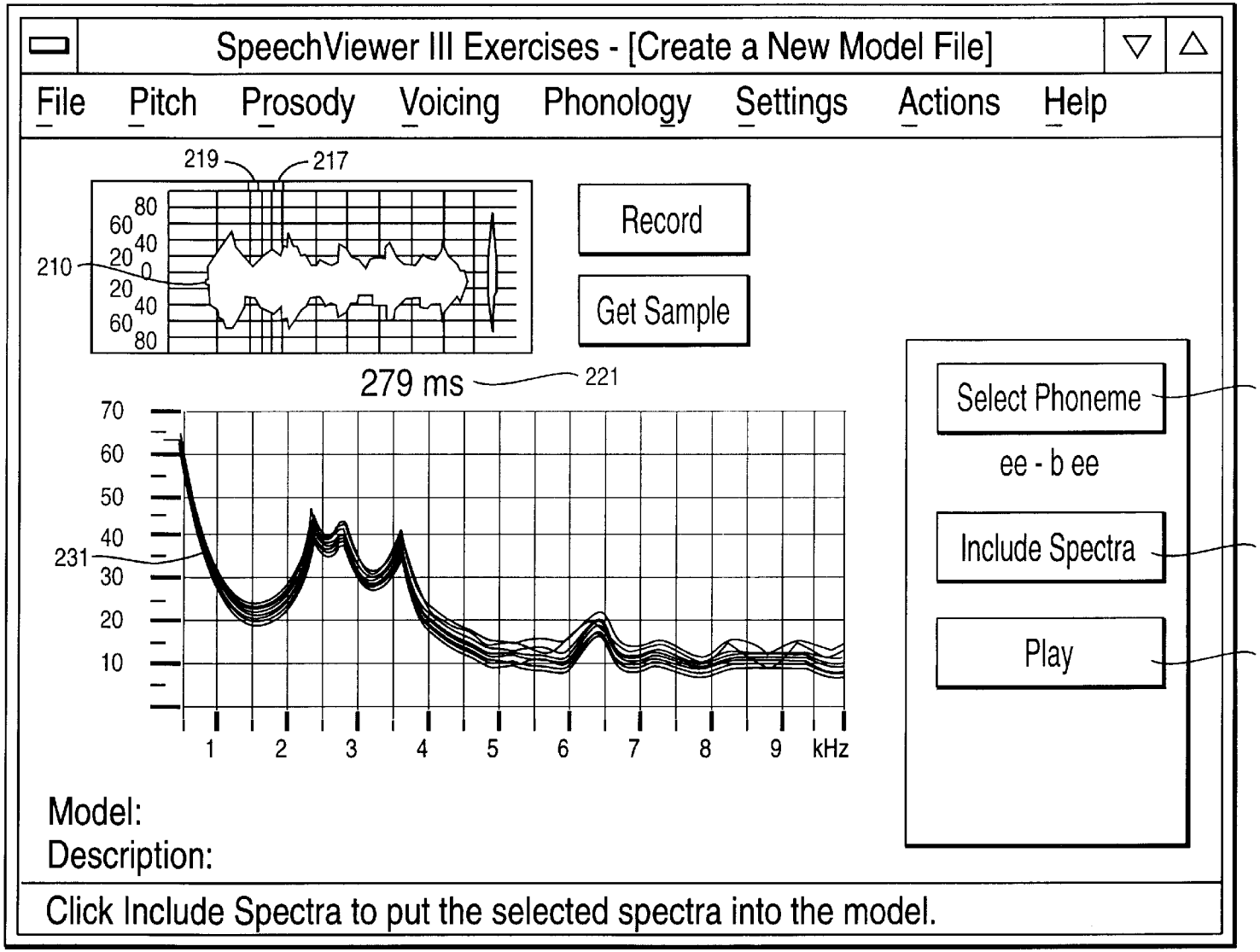
Figure 5:
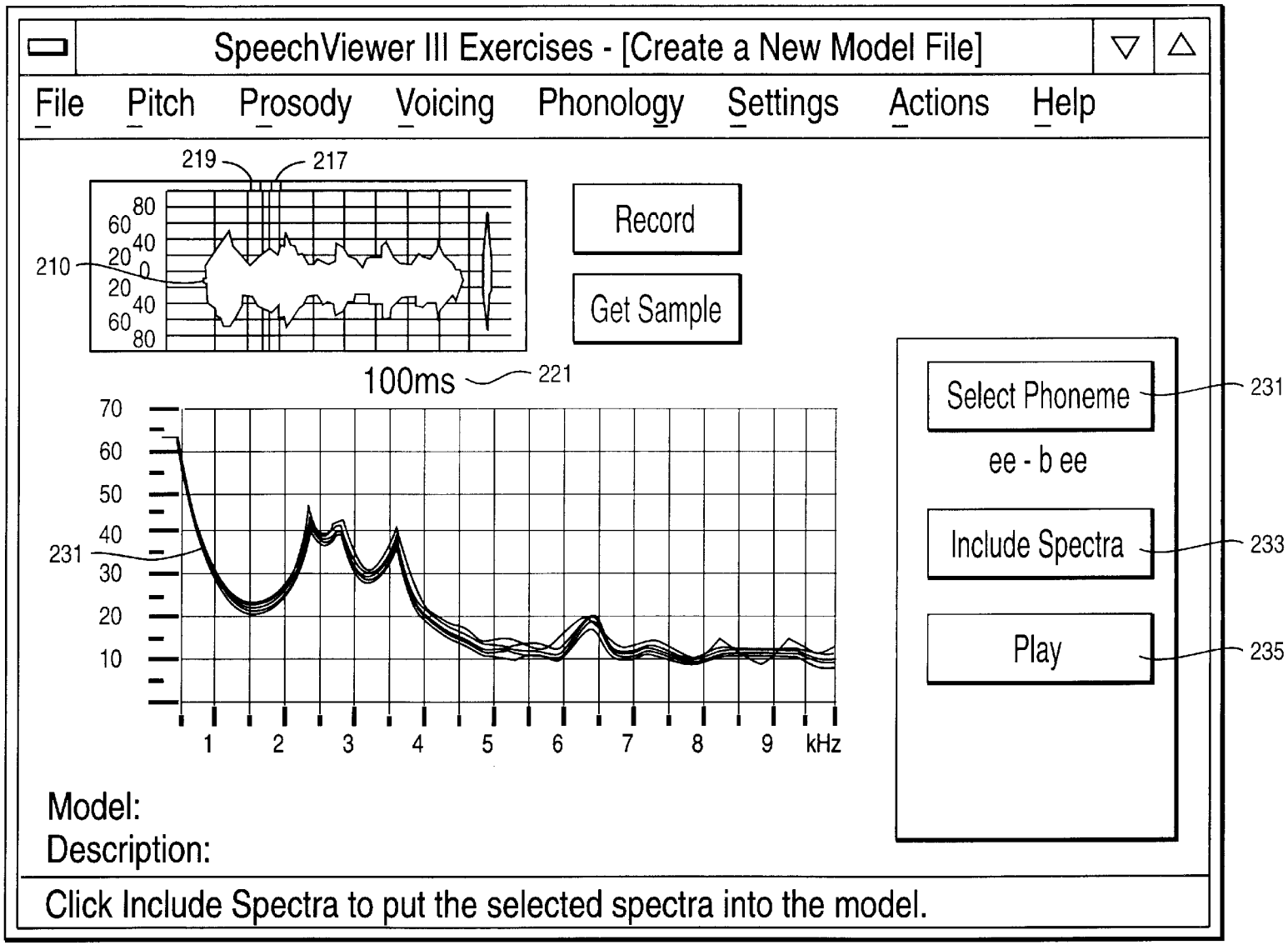

As shown in FIGS. 3–5, the speech signal is displayed in a user interface in a graphical manner. In the preferred embodiment, the user interface is a windowing environment wherein a main window 200 has typical features such as a title bar 201, action bar 203 and client area 205. The client area 205 has three subareas: the amplitude vs. time graph 207, the spectral frequency graph 209 and the push button container 211.

The amplitude vs. time graph 207 displays the amplitudes 210 of each frame or a group of frames in a deviation-from-zero amplitude display on the vertical axis 213 as a function of time displayed on the horizontal axis 215. Each column of pixels displays amplitude information for 1, 2, 4, or 8 frames when the graph displays 2.5, 10, or 20 seconds respectively. The amplitude chosen for 1 frame given by the function is MAX (ABS (largest sample), ABS (smallest sample)), that is, the largest absolute value amplitude among the 256 samples comprising the frame. If each pixel represents more than one frame, the amplitude is an average. The time scale along the horizontal axis can be set to 2.5, 5.0, 10.0, or 20 seconds, via a pull down menu or other means. The longer time settings are helpful when the user is attempting to capture a model from a running speech sample. One-second time increments are indicated on the horizontal time axis of the display. The vertical markers 217, 219 are used to select a portion of the displayed speech sample as a candidate for inclusion as a phoneme model for the selected phoneme. Note that the millisecond indicator 221 indicates the length of time between the two vertical markers. The Record push button 223 and the Get Sample push button 225 are associated with the amplitude region.

Periodicity within a window is determined to detect the presence or absence of voicing in the frame. Voicing occurs when the vocal cords are used and this results in a periodic speech signal. If periodicity is detected, the amplitude is displayed in red. Periodicity is detected by determining if the zero crossings in the sample are characterized by a periodic interval. If none is detected, but the speech amplitude is above a predetermined level, the amplitude is displayed in green. This color coding is used to help the user determine phoneme boundaries and the presence of noise in the signal. Other alternatives exist to the amplitude vs. time graph, e.g., pitch vs. time, depending on which voice characteristics are most useful when graphed to determine the likely boundaries of a candidate speech sample.

In the spectral frequency area 209, spectral lines 231 are presented on a 2-dimensional matrix with frequency on the horizontal axis 233 and relative intensity on the vertical axis 235. The vertical markers mark the beginning and end of the speech segment from which spectra are calculated. Spectra are calculated for each frame in the marked area of the amplitude vs. time graph 207 (except the first two). The spectra shown in the area correspond to the area within the vertical markers 217, 219 in the amplitude vs. time graph 201. The method wherein the spectral lines calculated and presented and related to the position of the vertical markers is described in greater detail below.

In one preferred embodiment, new spectra are displayed in black, while compacted spectra already part of the model are displayed in a different manner, e.g., in blue. The spectra lines should be reasonably close to each other. Note that the spectra lines in FIG. 4 are much closer than that in FIG. 3 so that it is a better sample.

The push button container 211 holds push button icons 231, 233, 235 which provide functions such as select phoneme, include spectra, play speech sample and save file as appropriate for the given point in the phoneme creation process.

FIG. 3 shows the user interface after a phoneme has been selected by the user and a speech sample which contains the selected phoneme has been recorded by the user from the microphone or otherwise input to the system. The vertical markers 217, 219 provide a means for the user to adjust that portion of the speech sample under consideration for a phoneme model. In one preferred embodiment, the system will make some sort of "guess" as to the positions of the markers. If the user needs to enlarge or restrict the portion, he will drag the left or right marker 217, 219 with his mouse pointer as appropriate. The user may listen to the marked segment by selecting the play push button in the pushbutton container 211. The system actions taken in response to this input are discussed in greater detail below.

In FIG. 4, the user has adjusted the vertical markers 217, 219 to constrain the portion of the speech sample to a narrower segment. Note that the millisecond indicator 221 which indicates the number of milliseconds in the selected speech sample has changed. The spectra 231 from this segment are shown in the spectral frequency graph 209. Note that the spectra 231 in FIG. 4 when compared to those in FIG. 3 are tighter in spacing, indicating a purer sound.

In FIG. 5, the vertical markers 217, 219 have been adjusted by the user further until the spectra 231 are relatively compact, indicating that no gross deviations are present in the marked speech sample. Thus, the marked segment would be suitable for inclusion in the phoneme model.

The various elements of the user interface, e.g., pushbuttons, can be displayed by calling functions available in the operating system. Amplitude vs. time graph is drawn by calling windows functions to a draw a single vertical line for each frame or group of frames. A spectrum is drawn by calling a function to draw a polyline. The vertical markers are drawn by calling functions to drawn boxes and lines. When the mouse is clicked, events are passed from the operating system to the speech tool. For example, when a button changes status from unpressed to pressed and from pressed to unpressed, a separate event also represent the composite of the full click cycle, i.e. the press and unpress of a button. Similarly, events provide the x and y position of the mouse and mouse movement events. These events are passed to the speech tool and used to know when the user holds the left mouse down on a marker. In response to mouse movement events, the marker is redisplayed at a new position. Once the left button is released, further mouse movement events will not result in movement of a marker.

Acoustic Spectral Analysis

While those skilled in the art of speech recognition will understand that a variety of analysis techniques may be used within the scope of the present invention, one preferred procedure is discussed below.

The analog signal is converted to a digital representation by sampling the analog signal 22,050 times per second or every 1/22050 seconds. The digitized speech samples are signed sixteen bit values and are grouped into frames of 256 samples, or 11.6 milliseconds of speech. The incoming speech sample could be from the microphone attached to the system or previously recorded and fed into the system from a line feed. Next, the amplitude values are grouped into frames of 256 samples, or 11.6 milliseconds of speech. A frame is a collection of 256 samples, one commonly used grouping of audio data, which is analyzed by the acoustic processing routines. In the preferred embodiment, amplitude is extracted from 1 frame, pitch is extracted from 4 low pass filtered frames, spectra are extracted from 3 frames. Determining the frame size was a difficult process. If the frame size was too large, there would be too much latency between the user's utterance and visual feedback. If it was too short, the audio device driver would fail because it could not deliver frames quickly enough.

The acoustic processing algorithm looks for four continuous nonsilent frames, i.e. 46.4 ms of continuous speech. Each Spectrum is computed over three frames, or 34.8 milliseconds of speech. In the preferred embodiment, spectra are computed with a Hamming Window weighting with Linear Predictive Coding (LPC). Both Hamming Windows and LPC are well known to the art. In one preferred embodiment, the computation equation is:

$$h(n)=0.54-0.46\cos(2\pi n/(N-1)) \quad 0<=n<=N-1$$ [where N is 768 (3 frames of 256 samples)]

No spectra are computed for the first and second frames in a sample, but these frames are included into the computation for the spectrum that includes the 3rd frame. For a typical computer system, up to 43 overlapping spectra may be computed for a given speech segment. After the computation, the spectra are kept in a stack of the 4 most recent spectra. This stack is analyzed for stability, that is, each of the four are compared to a spectrum representing an average of the four. All four spectra must be "close"—within, for example, 5 db of the average. This is done so results of analyzing unstable portions of speech can be ignored.

Compaction Threshold

Compaction is process of "weeding out" unnecessary spectra from the model. The compaction threshold is the number which gives an indication of the size of the area between any two spectra. The compaction process uses the spectral distance to determine if spectra are "too close" to each other, i.e. redundant. The spectral distance is computed by squaring the difference between each of 74 frequency points and summing the squares. Smaller numbers indicate closeness. A high threshold saves memory and increase performance of recognition with a large number of samples. When fewer samples for a particular phoneme model are collected, a lower threshold would be appropriate.

During the compaction process, the first spectrum is saved in the memory allocated for the model. Then, each of the remaining spectra are compared one at a time to the saved spectrum. If the area between the candidate spectra and the spectra already in the model is less than the current compaction threshold, the candidate spectra is discarded. They are deemed to be redundant. If the compared spectra are sufficiently different to the saved spectra, they is also saved in the model, adding to the spectra which comprise the phoneme model. They are deemed to be sufficiently different from previous spectra to be essential as a representative of the family of sounds that constitutes a phoneme.

Speech Playback

As mentioned above, one of the means provided by the invention to determine the acceptability of a marked segment is to playback the marked segment to the user. To play the segment back, the marked portion on the screen must be related to the relevant portion of the actual digitized speech. The number of pixels between the start of the amplitude vs. time graph and the marker determines an offset into the sequence of frames representing the speech signal. In 2.5 second mode, there is 1 frame per pixel. For example, an offset of 10 pixels marks the point 10 frames (116 ms) into the speech sample. Thus, the speech tool uses this relationship to determine which portion of the speech sample corresponds to the marked segment in the interface.

Detailed Procedures

Figure 6:
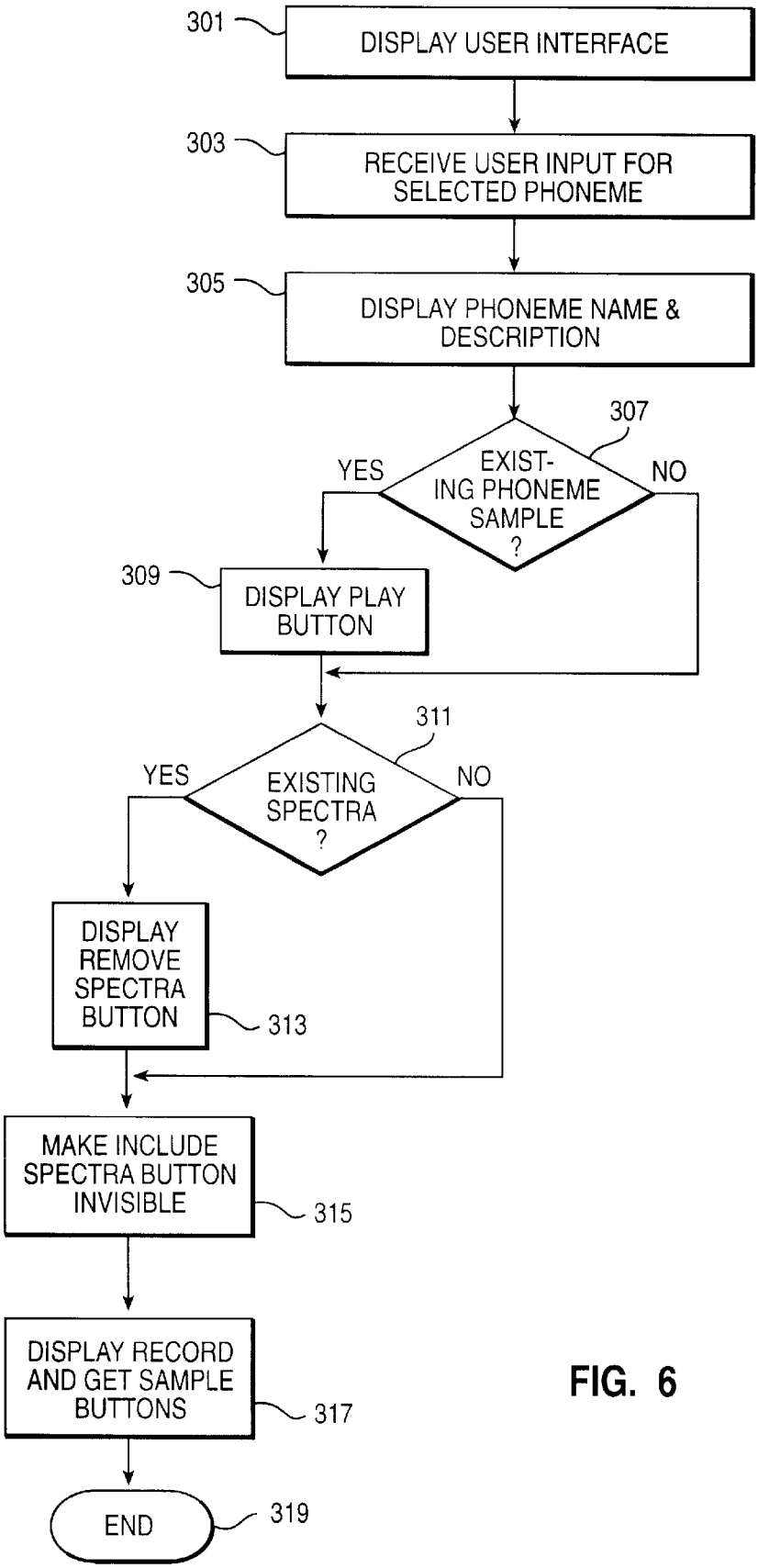
FIGS. 6–10 are flow diagrams of detailed procedure for one preferred embodiment of the present invention.

FIG. 6 shows the Select Phoneme subroutine which allows the user to pick a particular phoneme to be modelled. One skilled in the art would appreciate that in other embodiments, e.g., singing, the selection may be for a different sort of human sound, e.g., a vocal arpeggio exercise.

In one preferred embodiment of the invention, a file shipped with the product contains information for each phoneme such as external name, a one or two letter code that the user uses to differentiate between different phonemes, internal code name, a single byte used by the program to differentiate between different phonemes and a short example of the use of the phoneme, e.g. b ee for the ee phoneme. Other information such as a file extension, e.g., a one to three character file extension used to differentiate between the different phoneme voice samples for a particular model file may be included. This file is read and an internal table is created containing an entry for each phoneme. Each entry contains: PhonemeExternal(i)—External code; PhonemeInternal(i)—Internal code; PhonemeDescription(i)—External Example; PhonemeExtension(i)—File extension for this phoneme.

As shown in FIG. 6, the system may use this table to generate a user interface, step 301. The system in step 303, receives the user selection of a phoneme, e.g., made by clicking one of a set of check boxes on a Select Phoneme dialog box. In step 305, responsive to the selection of a phoneme, the table is read for the external name, PhonemeExternal(i) and external description, PhonemeDescription(i) which are then displayed. The test in step 307 determines if there is an existing speech sample. If so in step 309, the Play button is displayed using the text PhonemeExternal(i) from the table.

If there are already spectra in the model file for the selected phoneme, step 311, display the Remove Spectra button, step 313. At this point in time, there are no new spectra to be included in the phoneme model so the Include Spectra button is made invisible so avoid user error, step 315. To record or import a new spectra sample, the Record and Get Sample buttons are made visible in the interface, step 317. The process ends, step 319.

Figure 7:
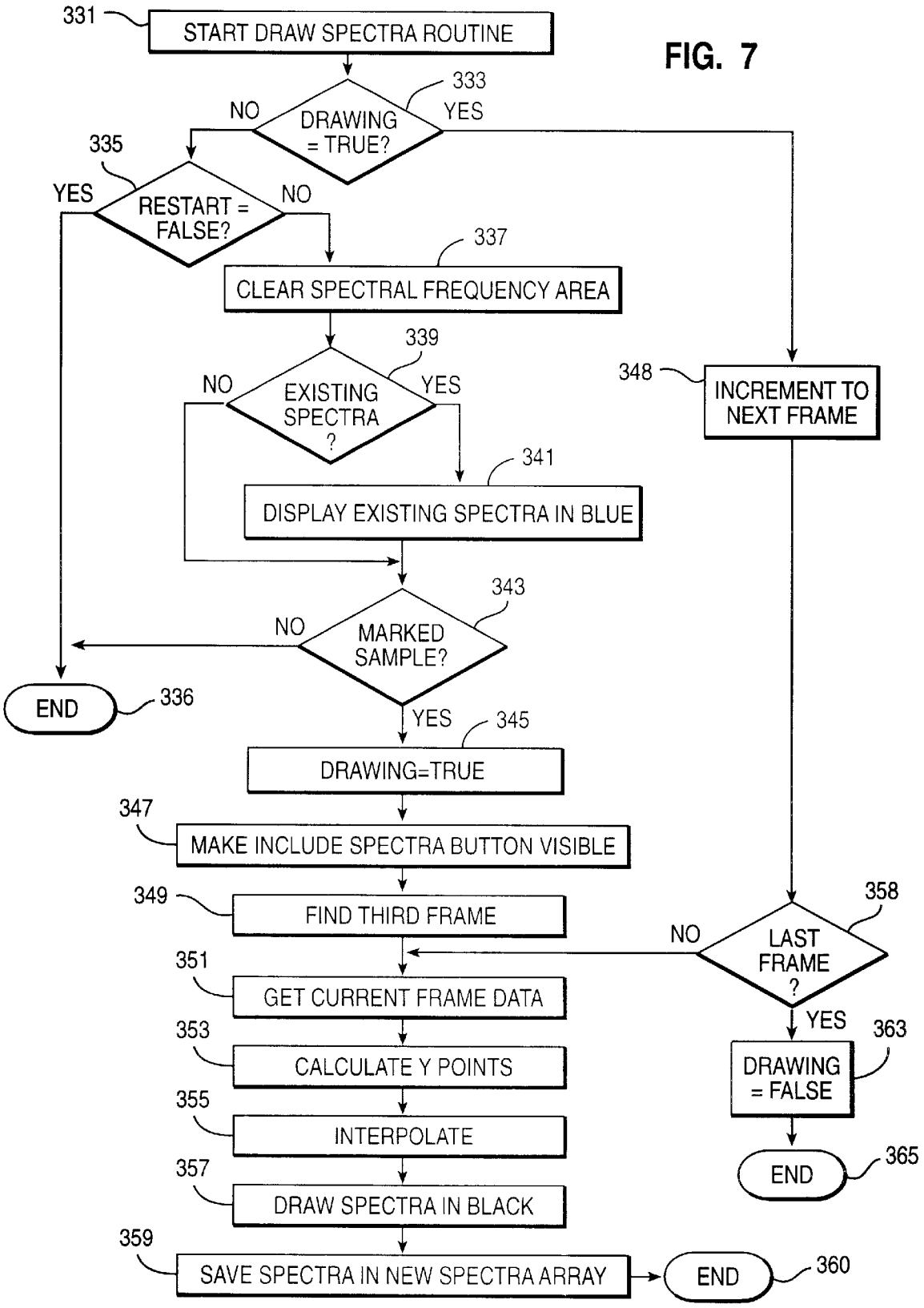

The Draw Spectra routine is shown in FIG. 7. In one embodiment of the invention, a main processing loop exists which allows for the handling of any user initiated events such as keyboard or mouse activity. Each time through the loop, the DrawSpectra subroutine begins step 331 to allow it to compute and draw a single spectrum. Referring to the interface shown in FIGS. 3–5, each time the DrawSpectra routine is called, it processes a single frame starting with the frame just to the right of the left marker and ending with the frame just left of the right marker. Alternatively, as described below, the Drawing flag may be set to false because the user has provided input that would imply that new spectra should be drawn such as moving the markers or recording a new speech sample.

In step 333, the test determines if Drawing=True. If so, the process goes to step 348 to increment to the next frame. In step 350, a test for the last frame is performed. If so, steps 351 through 359 (explained below) are performed. The subroutine exits at step 360. If so, in step 363 set Drawing=False. In step 365, end the subroutine. In step 333, if the test determines that Drawing=False, the test in step 335 determines if Restart=False. If so, then the process exits the subroutine in step 336. In step 337, the spectral frequency area is cleared for the new spectra. The process reads through the in-memory copy of the phoneme model array; if spectra are found, step 339, they are displayed in blue in step 341. In step 343, a test is performed to determine whether there is any speech marked as a potential candidate for inclusion in the model. If no speech is marked off, then the process exits the subroutine, step 336. If speech is marked, step 345 sets drawing to true.

In step 347, the Include Spectra button is made visible to allow the user to include the spectrum in the model if desired. In step 349, the third frame associated with the pixel location just right of the left marker is found. For the calculations used in the preferred embodiment of the invention, at least three frames are needed to compute the spectra. If the spectrum for the current frame is not yet processed, in step 351 the current frame's spectral values from the signal processing system are received and saved. In step 353, the 101 Y values for this frame's spectrum are calculated. This is a scaling of a 16 bit value (0 to 65535) to a pixel value (0–235). In the interface shown in FIGS. 3–5, 236 pixels of screen real estate are allocated to the Spectra Frequency Area. Also, there are 74 spectral points in each spectrum provided by the signal processing subsystem, but 101 frequency points to be displayed on the graph. The first 47 spectral points specify 0 to 4600 Hz, with 100 Hz spacing. The last 27 spectral points specify 4800 Hz to 10,000 Hz with 200 Hz spacing. Each 100 Hz increment in frequency is graphed. The intermediate 100 Hz values missing in the spectral information between 4800 Hz and 10,000 Hz are interpolated by averaging the points 100 Hz above and below the missing point, step 355.

A flag may be set showing that the spectra for the current frame have been processed. In step 357, the spectra on the screen are displayed in black in the interface. In step 359, the spectra are saved in an array of new spectra in case the user wants to later include the spectra in a model file.

Figure 8:
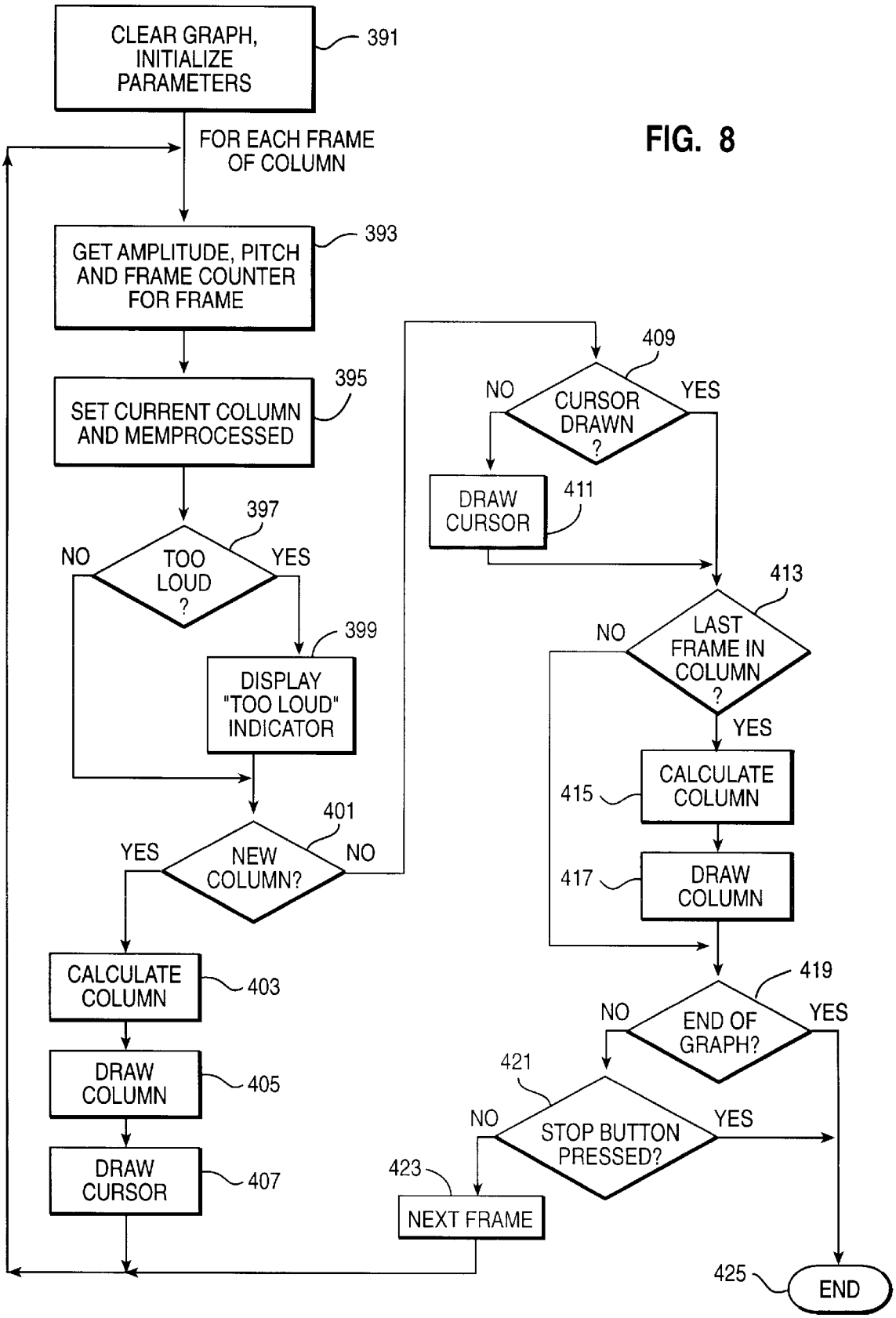
Figure 9:
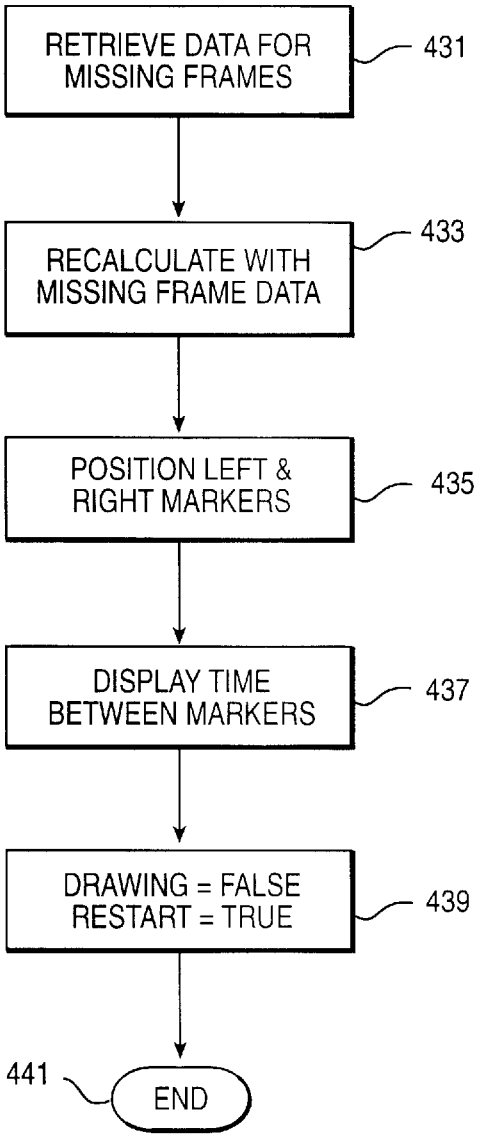

FIGS. 8 and 9 show the Record Phoneme subroutine. In the interface shown in FIGS. 3–5, each column of pixels represents 1, 2, 4, or 8 frames dependent on whether the time scale is set to 2.5, 5, 10, or 20 seconds respectively. A frame is a collection of 256 samples, the basic unit of acoustic processing.

When the speech processing subsystem is queried for data, only the most recently available frame is retrieved when extracting speech parameters. Due to the overhead associated with other processing it may not be possible to do acoustic processing on all incoming frames. However, all incoming frames are saved and low-pass filtered as they are received from the audio subsystem. Every frame has a unique incremental frame counter associated with it. Every increment of the frame count is equivalent to the passage of 11.6 ms. This is due to a sampling rate of 22050 Hz and a frame size of 256 samples, i.e. 256/22050=11.6 ms.

In step 391, the Amplitude vs. Time graph area is cleared and the MemProcessedo and ColumnDrawn() arrays to are set to False in the initialization step. For each frame associated with each column of pixels until the Record/Stop button is pressed or the end of the graph is reached, the following process is performed. In step 393, the amplitude, pitch, and frame counter for the most recent frame is received from the acoustic processing subsystem and the values saved to memory. In step 395, the CurrentColumn variable is set to the column associated with frame just received from the acoustic processing subsystem. Also in step 395, the MemProcessed(frame) flag is set to True for the frame just processed. The test in step 397 determines if the sound is too loud. In one embodiment, this may be based on a user defined too loud value. If so, in step 399, the "too loud" indicator is displayed.

In step 401, a test is performed to determine if this is a new column. This determination of which column to display may be made based on the frame counter parameter returned with the most recently processed frame. If this is a new column, the cursor from the prior column is removed and the prior column is calculated by averaging the pitch and amplitude values for all the frames associated with the prior column. In step 403, the prior column of pixels is drawn. In the embodiment of the interface shown in FIGS. 3–5, height is based on amplitude and color is based on if pitch was detected. Pitch indicates a voiced speech segment. Red is used for voiced segments and green for unvoiced segments. In step 407, the cursor is drawn at the new column location.

If the test in step 401 indicated that the frame was not for a new column, a test in step 409 determines whether the cursor is drawn. If not, in step 411, draw the cursor if it is not already drawn. The test in step 413 determines whether it is the last frame for this column. If so, in step 415 the column is calculated by averaging the pitch and amplitude values for all the frames associated with this column. In step 417, the column of pixels is drawn where height is based on amplitude and color is based on pitch.

The tests in steps 419 and 421 determine whether it is the end of the graph or the stop button is depressed. If neither, then the next frame is retrieved and the processed repeated.

Note that at this point in time, the speech sample has been captured in real time. Some of the data may not have been computed or displayed due to processing overhead. However, all incoming frames are saved and low-pass filtered. When the process in FIG. 8 displayed data, it only displayed data for the most recently available frame. Frames which did not have pitch and amplitude computed are indicated by those entries in the MemProcessed ( ) array that are False. The process shown in FIG. 9 goes back through the frames of captured data and displays the pitch and amplitude information for any frames not displayed during the first pass shown in FIG. 8 done in real time to display a corrected version of the amplitude v. time graph.

For each column until the last recorded frame or the end of the graph is reached, and for each frame=first frame of current column to last frame of current column. A flag, MemProcessed(Frame), processing is set to False if the frame was not processed in real time. If that flag is false, the frames which were saved during the real time processing are used by the signal processing system to compute amplitude and to recalculate a 5 point smoothed pitch value. The acoustic processing subsystem calculates smoothed pitch when data is captured sequentially in real time, but in this case it has to be done by the RecordPhoneme subroutine code. One method is as follows: If there are five non-silent frames, including this frame and the four before it, find the median pitch value of the five frames. Otherwise, use a smoothed pitch value of 0. Based on this recalculation, the pitch and amplitude values for this frame are saved. The MemProcessed(Frame) is set to True for this frame.

In step 435, the left marker is positioned at the first point on the graph where the amplitude is greater than one percent of maximum and the right marker is positioned at the last point on the graph where the amplitude is greater than one percent of maximum, but no further than 500 ms and no closer than 100 ms from the first marker. Note that no more than 500 ms is marked off since the applicants have found that naturally occurring phonemes will be no longer than 500 ms. No less than 100 ms is marked off because a user would not be able to listen to a such a short speech sample and be able to distinguish which phoneme it represented. One skilled in the art would recognize that, for other embodiments of the invention such as singing different default marker positions would be used. In step 437, the number of milliseconds of speech that was marked off is displayed. In step 439, the Drawing flag is set to False to stop any existing spectra from drawing and the Restart flag is set to True to restart drawing spectra. The process ends, step 441.

Since the markers have been set at the beginning of the speech segment and the Restart flag is True, the code in the DrawSpectra subroutine will cause spectra to appear in the Spectral Frequency Area.

Figure 10:
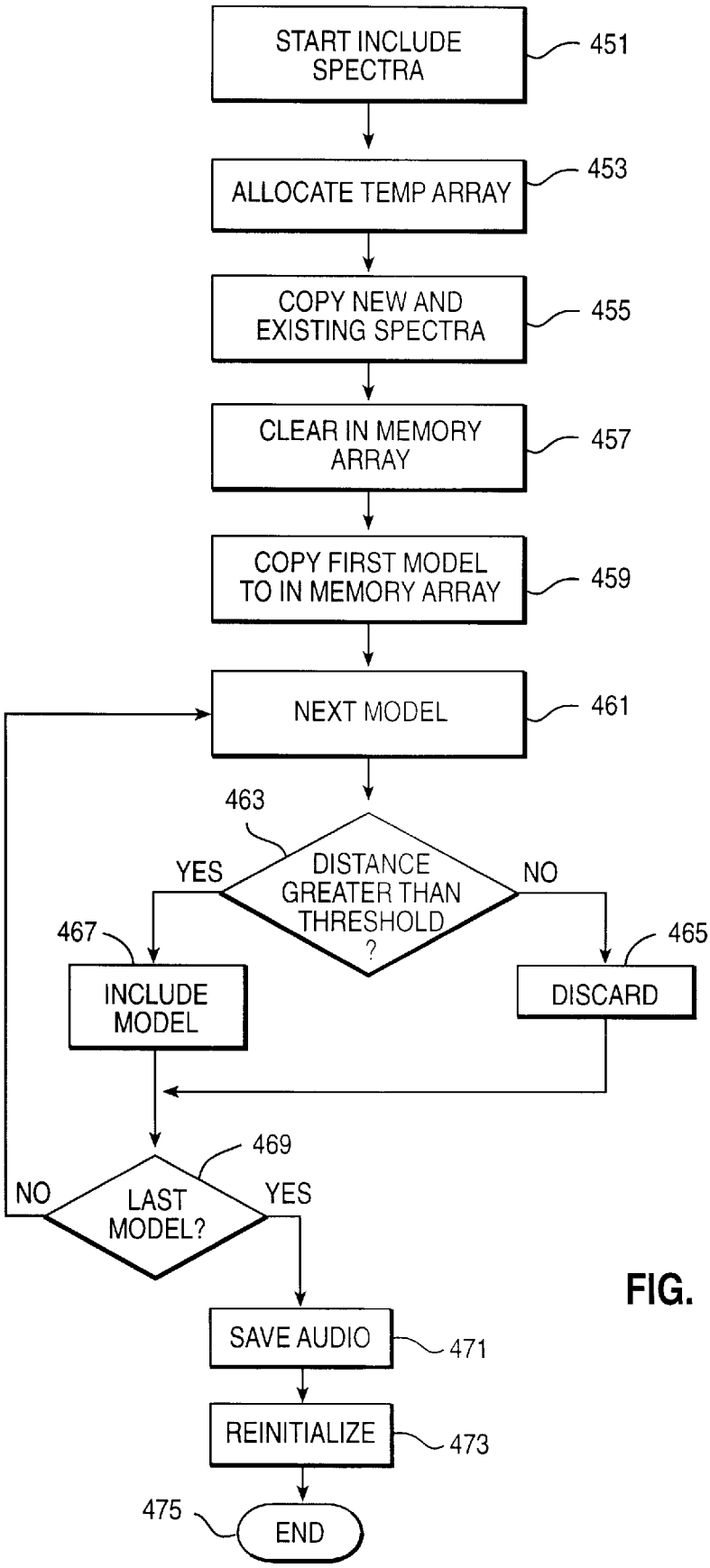

The Include Spectra routine is shown in FIG. 10. Note that in the preferred embodiment, the new spectra which are displayed in black are compacted and saved in the in-memory copy of the model file which contains the models for the currently selected phoneme. The process is called in step 453. In step 453, a temporary array is allocated which is large enough to hold all the existing models for the current phoneme and all the new models. In step 455, all the old and new mode are copied into the temporary array. Clear the in-memory model array, step 457. In step 459, the first model is copied from the temporary array to the in-memory model array. For each of the remaining models in the temporary array, determine its distance to the closest model in the in-memory model array. The distance is computed by summing the squares of the distances between corresponding spectral points in the two models being compared. If that distance is above the user defined compaction threshold, step 463, copy the model from the temporary array to the in-memory model, step 467. Otherwise, discard it in step 465. Test 469 is performed to determine whether there are more models to be compared and possibly compacted.

In step 471, the audio sample associated with the marked speech segment is saved into a speech sample audio file if the marked speech segment is longer than any existing saved speech sample or if there is no speech sample saved. Step 473 reinitializes the interface by setting the Drawing flag to False and moving the markers all the way to the left so no spectra will be displayed in the Spectral Frequency Area, making the Include Spectra button invisible and making the Remove Spectra, Play, and Save File buttons visible. The process ends step 475.

While the invention has been shown and described with reference to particular embodiments thereof, it will be understood by those skilled in the art that the invention can be practiced, with modification, in other environments. For example, although the invention described above can be conveniently implemented in a general purpose computer selectively reconfigured or activated by software, those skilled in the art would recognize that the invention could be carried out in hardware, in firmware or in any combination of software, firmware or hardware including a special purpose apparatus specifically designed to perform the described invention. Therefore, changes in form and detail may be made therein without departing from the spirit and scope of the invention as set forth in the accompanying claims.

We claim:

1. A method for selecting human speech samples for a speech model of human speech, the speech model including audio data specific to a particular sound in human speech, comprising the steps of:

presenting a graphic representing a human speech sample in a first area of a user interface on a computer display;

responsive to user input, marking a segment of the graphic, the marked segment of the graphic representing a portion of the human speech sample;

responsive to user input, playing the portion of the human speech sample represented by the marked segment; and selecting the portion of the human speech sample for inclusion in the speech model, wherein the human speech sample is used for evaluating the accuracy of a later produced human speech sample as the particular sound.

2. The method as recited in claim 1, further comprising the steps of:

analyzing the portion of the human speech sample represented by the marked segment for acoustic properties;

presenting a graphic of the analyzed portion representative of the acoustic properties in a second area of the user interface;

wherein the graphic of the analyzed portion depicts different acoustic properties than presented in the marked section.

3. The method as recited in claim 2 wherein the graphic representing the speech sample is an amplitude versus time graph of the speech sample and the graphic of the analyzed portion is a graph of spectral lines of the portion of the speech sample represented by the marked segment.

4. The method as recited in claim 2, further comprising the steps of:

searching for an existing speech model;

presenting a graphic of the existing speech model in the second area of the user interface in a different manner than the graphic of the analyzed portion.

5. The method as recited in claim 1, wherein portions of a plurality of speech samples each portion containing audio data for the particular sound comprise the speech model.

6. The method as recited in claim 5, further comprising the steps of:

storing a first speech sample selected for inclusion in the speech model;

comparing elements of a second speech sample to corresponding elements of the first speech sample; and storing those elements of the second speech sample which diverge from the elements of the first speech sample by a prescribed amount with the first speech sample.

7. The method as recited in claim 4 wherein the prescribed amount of divergence is an adjustable value through the user interface.

8. The method as recited in claim 1 wherein the speech model is for a phoneme.

9. A system including processor, memory, display and input devices for selecting human speech samples for a speech model of human speech, the speech model including audio data specific to a particular sound in human speech comprising:

means for presenting a graphic representing acoustic values of a speech sample in a first area of a user interface on the display;

means responsive to user input for marking a segment of the graphic, the marked segment of the graphic representing a portion of the speech sample;

means for analyzing the portion of the speech sample represented by the marked segment for acoustic properties different from the acoustic values;

means for presenting a graphic of the analyzed portion representative of the acoustic properties in a second area of the user interface; and means for selecting the analyzed portion for inclusion in the speech model.

10. The system as recited in claim 9, further comprising means responsive to user input for playing the portion of the speech sample represented by the marked segment.

11. The system as recited in claim 9 further comprising:

means for analyzing the speech sample for desired acoustic properties; and means responsive to identifying desired acoustic properties in the speech sample for marking a segment of the graphic corresponding to the portion of the speech sample with the desired acoustic properties.

12. The system as recited in claim 9 wherein elements from a plurality of speech samples are added to the speech model and are compacted according to a compaction threshold.

13. The system as recited in claim 9 wherein one of the input devices is a microphone and the system further comprises:

means for generating a real time graphic of a speech sample as captured from the microphone; and means for correcting the real time graphic to produce a corrected graphic according to frames which were missing during the generation of the real time graphic.

14. The system as recited in claim 9 wherein one of the input devices is a pointing device and wherein the means for marking the segment of the graphic are two vertical markers which are independently manipulated through pointing device input.

15. A computer program product in a computer readable medium for selecting human speech samples for a speech model of human speech, the speech model including audio data specific to a particular sound in human speech, comprising:

means for presenting a graphic representing acoustic values of a speech sample in a first area of a user interface on the display;

means for analyzing the speech sample for desired acoustic properties;

means for presenting a graphic of an analyzed portion representative of the desired acoustic properties in a second area of the user interface, wherein the desired acoustic properties are different from acoustic values presented in the first area; and means for including the speech sample in the speech model.

16. The product as recited in claim 15 further comprising means responsive to user input for marking a segment of the graphic, the marked segment of the graphic representing a portion of the speech sample wherein the analyzing means analyzes the portion of the speech sample and the including means includes the portion of the speech sample in the speech model.

17. The product as recited in claim 16, further comprising:

means for searching for an existing speech model;

means for presenting a graphic of the existing speech model in the second area of the user interface in a different manner than the graphic of the analyzed portion.

18. The product as recited in claim 16 further comprising means for displaying detected pitch in the speech sample in a different manner from portions of the speech sample where no pitch is detected.

19. The product as recited in claim 15, further comprising means responsive to user input for playing the speech sample.

20. The product as recited in claim 15 further comprising means for compacting a plurality of speech samples in the speech model.

21. The product as recited in claim 15 further comprising means for displaying a graphic of an existing speech model concurrently with the graphics in the first and second areas.

* * * * *